US005395549A

United States Patent [19]

Ozaki et al.

[11] Patent Number: 5,395,549

[45] Date of Patent: Mar. 7, 1995

[54] FIBER TREATMENT COMPOSITION CONTAINING ORGANOSILANE, ORGANOPOLYSILOXANE AND COLLOIDAL SILICA

[75] Inventors: Masaru Ozaki; Isao Ona, both of Chiba, Japan

[73] Assignee: Dow Corning Toray Silicone Co., Ltd., Tokyo, Japan

[21] Appl. No.: 56,144

[22] Filed: Apr. 30, 1993

Related U.S. Application Data

[63] Continuation of Ser. No. 751,466, Aug. 29, 1991, abandoned.

[30] Foreign Application Priority Data

Sep. 5, 1990 [JP] Japan ..... 2-234842

[51] Int. Cl.[6] ..... C11D 7/34; C11D 3/12

[52] U.S. Cl. ..... 252/174; 252/8.6; 252/8.7; 252/8.8; 252/174.15; 252/DIG. 14

[58] Field of Search ..... 252/8.6, 8.8, 174.15, 252/174, DIG. 14, 8.7

[56] References Cited

U.S. PATENT DOCUMENTS

| | | | |
|---|---|---|---|
| 4,399,247 | 8/1983 | Ona et al. | 524/204 |
| 4,427,815 | 1/1984 | Ona et al. | 324/315 |
| 4,496,687 | 1/1985 | Okada | 324/589 |
| 4,541,936 | 9/1985 | Ona et al. | 252/8.6 |
| 5,017,297 | 5/1991 | Spyropoulos | 252/8.8 |
| 5,232,611 | 8/1993 | Ohashi | 252/8.6 |

FOREIGN PATENT DOCUMENTS

| | | |
|---|---|---|
| 0277740 | 8/1988 | European Pat. Off. . |
| 1221580 | 5/1989 | Japan . |
| 3152275 | 6/1991 | Japan . |
| 61-231272 | 10/1986 | Jordan . |

*Primary Examiner*—Paul Lieberman
*Assistant Examiner*—Kery A. Fries
*Attorney, Agent, or Firm*—Richard I. Gearhart

[57] ABSTRACT

The present invention provides a fiber treatment emulsion composition which can make animal fibers (mainly wool) resistant to the shrinkage arising from water-based laundering. The composition forms a strong, solid film by reaction among the base material, crosslinker, and colloidal silica as the water evaporates. These effects are reinforced by binding between the functional groups present in the fiber and such functional groups as the aminoalkyl groups bonded in the organopolysiloxane base material, the silanol groups bonded in the colloidal silica, and the amino, epoxy, methacryloxy, or acryloxy groups bonded in the crosslinker.

10 Claims, No Drawings

FIBER TREATMENT COMPOSITION CONTAINING ORGANOSILANE, ORGANOPOLYSILOXANE AND COLLOIDAL SILICA

This application is a continuation of Ser. No. 07/751,466, filed on Aug. 29, 1991, now abandoned.

BACKGROUND OF THE INVENTION

The present invention relates to a fiber treatment agent composition. In more particular terms, the present invention relates to an emulsion-type fiber treatment agent composition which generates an excellent handle and in particular which can impart shrinkage resistance to animal fibers.

When-subjected to water-based laundering, wool undergoes a gradual felting and severe shrinkage, and it has therefore been necessary up to now to dryclean 100% wool products (e.g., pants, suits, sweaters, etc.). This has created demand for the development of wool products which can be easily laundered even at home using detergent and water. One response has been to treat wool fiber or wool products with a urethane-based shrinkproofing agent, but this tactic results in a coarse and hard handle.

Aminoalkyl-containing organopolysiloxanes as disclosed in Japanese Patent Application Laid Open (Kokai or Unexamined) Numbers 49-69999 (69,999/74) and 49-71295 (71,295/74) have been employed in order to obtain improvement on this point. However, while this does in fact lead to an improvement in the handle, the laundering resistance is poor due to the use of the aminoalkyl-containing organopolysiloxane by itself. In Japanese Patent Application Laid Open Numbers 51-149354 (149,354/76) and 53-16759 (16,759/78), an improvement in the laundering resistance is obtained through the use of organohydrogenpolysiloxane to crosslink a compound which corresponds to the component (A) of the present invention. Nevertheless, the resistance to repeated laundering remains unsatisfactory.

BRIEF SUMMARY OF THE INVENTION

The present invention takes as its object a solution to the aforementioned problems by the introduction of a fiber treatment agent and in particular by the introduction of a fiber treatment agent composition which can make animal fibers (mainly wool) resistant to the shrinkage arising from water-based laundering.

DETAILED DESCRIPTION OF THE INVENTION

The aforesaid object is achieved by means of a fiber treatment agent composition which characteristically consists of (A) 100 weight parts organopolysiloxane which has a viscosity of at least 10 centistokes at 25 degrees Centigrade and which has the following general formula $$AR_2SiO(R_2SiO)_m(\underset{\substack{|\\ R^1(NHCH_2CH_2)_aNR^2R^3}}{RSiO})_nSiR_2A$$

wherein R is the same or different monovalent hydrocarbon group having 1 to 20 carbon atoms, $R^1$ is a divalent hydrocarbon group, $R^2$ and $R^3$ are groups selected from the hydrogen atom and monovalent hydrocarbon groups, the group A is the hydroxyl group or an alkoxy group, m and n are each integers with values of at least 1, and a is an integer with a value of zero to 5, (B) 0.1 to 30 weight parts organosilane with the following general formula $$\overset{\substack{R_b\\ |}}{Q}Si(OR^4)_{3-b}$$

wherein Q is a monovalent hydrocarbon group having 1 to 20 carbon atoms or a monovalent group which contains the epoxy group, amino group, acryloxy group, or methacryloxy group; R is a monovalent hydrocarbon group having 1 to 20 carbon atoms; $R^4$ is a monovalent hydrocarbon group having 1 to 5 carbon atoms; and b is an integer with a value of zero or 1; or partial hydrolysis condensate thereof, (C) 1 to 50 weight parts colloidal silica, (D) 0.1 to 20 weight parts condensation-reaction catalyst, (E) 1 to 30 weight parts surfactant selected from nonionic and cationic types, and (F) an arbitrary quantity of water.

To explain the preceding in greater detail, the organopolysiloxane moiety of component (A) imparts softness and smoothness, while its amino group supports strong binding to the fiber. As a result, component (A) functions to impart smoothness, softness, lubricity, and shrinkage resistance. Moreover, these functionalities are rendered durable through crosslinking reactions between component (B) and the hydroxyl or alkoxy groups present at the molecular chain terminals of component (A).

The groups R in the preceding general formula comprise monovalent hydrocarbon groups which have 1 to 20 carbon atoms. Examples in this regard are methyl, ethyl, propyl, butyl, pentyl, cyclohexyl, vinyl, allyl, 3,3,3-trifluoropropyl, and phenyl. It is not necessary that all the groups R in the individual molecule be identical. While R is most typically methyl, combinations of methyl with other groups are also typical. It is preferred that methyl comprise at least 50 mole % of the groups R. The groups $R^2$ and $R^3$ comprise groups selected from the hydrogen atom and monovalent hydrocarbon groups. The latter are exemplified by methyl, ethyl, propyl, phenyl, and cyclohexyl. The groups A, which participate in crosslinking with component (B), comprise the hydroxyl group or $C_1$ to $C_5$ alkoxy groups, and will generally be hydroxyl or methoxy. The group $R^1$ is a divalent hydrocarbon group, for which examples are alkylene groups such as $—CH_2—$, $—CH_2CH_2—$, $—CH_2CH_2CH_2—$, $—CH(CH_3)CH_2—$, and $—(CH_2)_4—$ and arylene groups such as $—(CH_2)_2—C_6H_4—$. The group $R^1$ is most typically ethylene or propylene. The subscripts m and n are integers with values of at least 1, and the viscosity must be at least 10 centistokes in order to generate softness, smoothness, compression recovery, crease resistance, and shrink resistance. Viscosities within the range of 50 to 10,000 centistokes are preferred. While a is an integer with a value of zero to 5, it is generally zero or 1. This component is readily prepared, for example, as disclosed in Japanese Patent Application Laid Open Number 53-98499 (98,499/78), by hydrolysis of the alkoxysilane $H_2N(CH_2)_3Si(CH_3)(OCH_3)_2$ with excess water and by then subjecting the hydrolysis condensate thus obtained to an equilibration reaction with dimethylcyclopolysiloxane using a basic catalyst such as sodium hydroxide with heating at 80 to 100 degrees Centigrade (end-blocker not used). The basic catalyst is then neutralized with acid when the desired viscosity is achieved.

Component (B) supports the development of a durable shrinkproofing, smoothness, and softness not only through crosslinking by reacting with the terminal alkoxy or hydroxyl groups in component (A), but also by reacting with the hydroxyl groups in the colloidal silica comprising component (C) and by the reaction of its amino or epoxy groups with the amino, carboxyl, and mercapto groups present in wool and silk.

The group Q in the preceding general formula comprises a monovalent group which contains the amino, epoxy, acryloxy, or methacryloxy group, or a $C_1$ to $C_{20}$ monovalent hydrocarbon group. The amino-containing monovalent group can be the same as the $-R^1(NHCH_2CH_2)_aNR^2R^3$ bonded in component (A). Typical examples here are $-CH_2CH_2CH_2NHCH_2CH_2NH_2$, $-CH_2CH_2CH_2NH_2$, $-CH_2CH(CH_3)CH_2NHCH_2CH_2NH_2$, $-CH_2CH_2CH_2N(CH_3)_2$. The epoxy-containing monovalent group is exemplified by

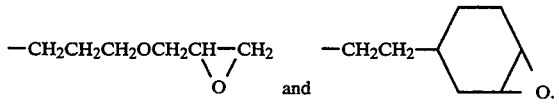

The acryloxy-containing monovalent group is exemplified by $-CH_2CH_2CH_2OOCCH{=}CH_2$, and the methacryloxy-containing monovalent group is exemplified by $-CH_2CH_2CH_2OOCC(CH_3){=}CH_2$. The $C_1$ to $C_{20}$ monovalent hydrocarbon groups are exemplified as for the group R described above. Amino-containing monovalent groups and epoxy-containing monovalent groups are most effective as the group Q. The group R is exemplified as for the group R in component (A). $R^4$ comprises $C_1$ to $C_5$ monovalent hydrocarbon groups, and typical examples are methyl, ethyl, and propyl. The subscript b is to have a value of zero or 1, but is preferably zero.

The organosilane comprising component (B) may be used as such, or it may be used in the form of the partial hydrolysis condensate prepared in advance by combining the organosilane, water, and a small amount of acid or alkali and maintaining at 50 to 70 degrees Centigrade. When component (B) is added at less than 0.1 weight parts per 100 weight parts component (A), adhesion by the organopolysiloxane film to the fiber will be poor. The addition of component (B) at more than 30 weight parts per 100 weight parts component (A) causes this film to be brittle and fragile. This component must therefore be used within the range of 0.1 to 30 weight parts since a durable shrinkproofing, softness, and smoothness are not obtained in either case. The preferred range is 0.5 to 10 weight parts.

The colloidal silica comprising component (C) corresponds to the colloid obtained by the hydrolysis of tetraethyl silicate or sodium silicate in surfactant-containing water. The particles, whose surfaces present large numbers of ≡SiOH groups, should have diameters of approximately 4 to 20 millimicrons. Component (C) is an essential component for imparting a durable character to the shrinkage resistance, softness, and smoothness: this is achieved through its condensation reaction and crosslinking with the alkoxy and hydroxyl groups in components (A) and (B) with the resulting formation of a solid, strong organopolysiloxane film. This colloidal silica is exemplified by the following products from Nissan Kagaku Kogyo Kabushiki Kaisha: Snowtex 20, Snowtex 30, Snowtex 40, Snowtex C, Snowtex N, Snowtex O, Snowtex S, Snowtex 20L, Snowtex OL, Snowtex ST-XS, Snowtex ST-SS, Snowtex AK, and Snowtex BK. In particular, the optimal selections are Snowtex AK and Snowtex BK, which are stable in the presence of nonionic and cationic surfactants. These colloidal silicas are generally available as the 5 to 40 weight % dispersions in water. Colloidal silica whose surface is covered with $Al^{+++}$, etc., is also very suitable. Component (C) should be added in the range of 1 to 50 weight parts (excluding water) per 100 weight parts component (A). At less than 1 weight part, a weak organopolysiloxane film is generated and the laundering resistance is lost. At more than 50 weight parts, the film is hard and the handle is therefore poor. The preferred range is 10 to 25 weight parts.

The condensation-reaction catalyst comprising component (D) functions to induce the crosslinking and curing of components (A), (B), and (C). This condensation-reaction catalyst is exemplified by organometallic catalysts and organosilicon-free amine catalysts. The organometallic catalysts are exemplified by tetrabutyl orthotitanate and by the metal salts of organic acids such as dibutyltin diacetate, dibutyltin dilaurate, dioctyltin dilaurate, dibutyltin dioctate, zinc naphthenate, cobalt naphthenate, zinc octylate, cobalt octylate, diisooctylmercaptoacetate dioctylate, zirconium naphthenate, and zirconium octylate. The organosilicon-free amine catalysts are exemplified by diethanolamine and triethanolamine. While component (D) should be used at 0.1 to 20 weight parts, 0.5 to 15 weight parts is preferred. In order to obtain its homogeneous dispersion, component (D) is preferably employed in the form of the emulsion obtained by its preliminary emulsification using nonionic or cationic surfactant.

Component (E) is a surfactant whose purpose is to emulsify component (A) and/or other components as necessary. Surfactant selected from the nonionic and cationic surfactants are ideally used for this, and examples here are polyoxyalkylene alkyl ethers, polyoxyalkylene alkylphenol ethers, polyoxyalkylene alkyl esters, sorbitan alkyl esters, polyoxyalkylene sorbitan alkyl esters, fatty amine salts, quaternary ammonium salts, and alkylpyridinium salts. One type or two or more types may be used from among the preceding. Component (E) is generally employed at 1 to 30 weight parts per 100 weight parts component (A).

The function of the water comprising component (F) is to emulsify the composition under consideration, and no particular restriction is placed on its use quantity.

The composition according to the present invention can be prepared, for example, by the addition of the water comprising component (F) and the surfactant comprising component (E) to the organopolysiloxane comprising component (A) and the organosilane or partial hydrolysis condensate thereof comprising component (B). Emulsification of the preceding is followed by addition of the already emulsified condensation-reaction catalyst comprising component (D). Aging for 10 to 20 days at room temperature will afford an even tougher organopolysiloxane-film.

In addition to components (A) through (F), the treatment agent composition according to the present invention may also contain, as necessary or desired, creaseproofing agents, thickeners, colorants, antiseptics/antimolds, rust preventives, organopolysiloxane other than component (A), and so forth.

Spraying, immersion, knife coating, etc., can be used to treat fiber with the treatment agent composition according to the present invention. Drying is then executed by standing at ambient temperature or by heating. Finally, heating for 3 to 10 minutes at 130 to 160 degrees Centigrade causes the rapid development of crosslinking reactions among component (A), component (B), and component (C) with the concomitant generation of a durable shrinkage resistance, rebound, softness, smoothness, crease resistance, and compression recovery.

Fibers which can treated with the treatment agent composition according to the present invention are exemplified by natural fibers such as wool, silk, alpaca, mohair, Angora, flax, cotton, and asbestos; regenerated fibers such as rayon and acetate; synthetic fibers such as polyester, polyamide, vinylon, polyacrylonitrile, polyethylene, polypropylene, and spandex; glass fiber; carbon fiber; and silicon carbide fiber. This fiber may be treated in the form of the staple, filament, tow, knit, weave, nonwoven, resin-finished fabric, artificial leather, and so forth, but the continuous treatment of the filament, tow, weave, knit, or nonwoven is particularly effective.

Illustrative examples follow, in which parts=weight parts, %=weight % and the viscosity is the value at 25 degrees Centigrade.

EXAMPLE 1

300 Parts organopolysiloxane with the following formula (viscosity=750 centistokes)

$$HOMe_2SiO(Me_2SiO)_{300}(\underset{\underset{C_3H_6NHCH_2CH_2NH_2}{|}}{MeSiO})_6SiMe_2OH$$

and 5 parts of the partial hydrolysis condensate of methyltrimethoxysilane (viscosity=55 centistokes) were mixed to homogeneity. 30 Parts polyoxyethylene lauryl ether (6 mole EO adduct) and 150 parts water were added with stirring to homogeneity, and this was subsequently emulsified using a colloid mill emulsifier. A remaining 515 parts water was then added to give a homogeneous emulsion designated as emulsion A.

Colloidal silica was added in the quantity reported in Table 1 in each case to 80 parts of this emulsion A. This colloidal silica was Snowtex AK from Nissan Kagaku Kogyo Kabushiki Kaisha, and contained 80% water and 20% colloidal silica. An emulsion catalyst was prepared by emulsifying 20 parts zinc octoate in 75 parts water, 2.5 parts polyoxyethylene (45 mole EO adduct) nonylphenol ether, and 2.5 parts dicocoalkyldimethylammonium chloride. 1 Part of this emulsion catalyst was added with mixing in each case to give the treatment baths with the mixing ratios reported in Table 1.

Three pieces of undyed 100% wool serge clothing fabric (45×45 cm) were immersed in the particular treatment bath for 30 seconds and then wrung out to a 100% expression ratio using a mangle roll. The samples were spread out on a wire screen and dried for 24 hours at room temperature. This was followed by heating for 5 minutes at 130 degrees Centigrade in a hot-air circulation dryer. After cooling by standing at room temperature, 30-cm intervals were marked off in each of 3 locations in both the warp and fill directions, and the samples were then laundered 5 times under the laundering conditions specified below. After drying spread out horizontally, the laundry shrinkage was evaluated in the warp and fill directions. The crease resistance (Monsanto method) was also evaluated based on JIS L-1096 (General Test Methods for Textiles), and the handle was evaluated by manual manipulation.

Laundering Conditions

One laundry cycle consisted of 1 laundering under the following conditions followed by two water rinses under the same conditions but omitting the detergent.

| | |
|---|---|
| bath ratio: | 1:50 |
| temperature: | 40 degrees Centigrade |
| detergent: | Zabu (weakly alkaline detergent from Kao Kabushiki Kaisha) |
| time: | 15 minutes |

As the results reported in Table 1 make clear, the treatment agent according to the present invention afforded an excellent handle and in particular produced very little laundry shrinkage even after 5 water-based laundry cycles. It thus proved to be very suitable as a treatment agent for 100% wool fabrics.

TABLE 1

| | | Invention Example | | Comparison Example | | | |
|---|---|---|---|---|---|---|---|
| | | 1 | 2 | 1 | 2 | 3 | 4 |
| Components, parts | | | | | | | |
| Emulsion (A | | 80 | 80 | 80 | 80 | 80 | — |
| Colloidal silica (20%) | | 35 | 20 | 80 | 0.5 | 0 | — |
| Emulsion catalyst | | 1.0 | 1.0 | 1.0 | 1.0 | 1.0 | — |
| Component conversions | Component (A) | 100 | 100 | 100 | 100 | 100 | — |
| | Component (B) | 1.7 | 1.7 | 1.7 | 1.7 | 1.7 | — |
| | Component (C) | 29.2 | 16.7 | 66.7 | 0.4 | 0 | — |
| | Component (D) | 0.83 | 0.83 | 0.83 | 0.83 | 0.83 | — |
| Evaluation | | | | | | | |
| Laundry shrinkage (%) | warp | 3.2 | 3.4 | 3.1 | 10.1 | 10.4 | 11.0 |
| | fill | 1.5 | 1.7 | 1.2 | 7.3 | 7.5 | 8.5 |
| | overall | 4.7 | 5.1 | 4.3 | 17.4 | 17.9 | 19.5 |
| Crease resistance (%) | warp | 85.5 | 84.8 | 85.9 | 81.1 | 80.0 | 78.8 |
| Handle* | | 1 | 1 | 2 | 3 | 3 | 4 |
| Bulk feel** | | 1 | 1 | — | — | — | — |
| Global | | 1 | 1 | 5 | 6 | 6 | 6 |

TABLE 1-continued

| | Invention Example | | Comparison Example | | | |
|---|---|---|---|---|---|---|
| | 1 | 2 | 1 | 2 | 3 | 4 |
| evaluation*** | | | | | | |

*1 = excellent; 2 = hard, somewhat paper-like; 3 very slippery feel; 4 = like wool.
**1 = excellent.
***5 = unsuitable, due to hard handle; 6 = unsuitable, due to large shrinkage.

EXAMPLE 2

A treatment bath (Invention Composition Number 3) was prepared as for Invention Composition Number 1 in Example 1, with the exception that 5 parts $H_2NCH_2CH_2NH(CH_2)_3Si(OCH_3)_3$ {gamma-(beta-aminoethyl)aminopropyltrimethoxysilane} was used in place of the 5 parts partial hydrolysis condensate of methyltrimethoxysilane used in Example 1. Testing was conducted as in Example 1. In addition, a treatment bath (Invention Composition Number 4) was prepared as for Invention Composition Number 3, with the exception that 5 parts gamma-methacryloxypropyltrimethoxysilane $$CH_2{=}C(CH_3)COO(CH_2)_3Si(OCH_3)_3$$

was used in place of the 5 parts gamma-(beta-aminoethyl)aminopropyltrimethoxysilane.

For comparison, treatment baths were prepared under the same conditions as above, but here using an amino group-free dimethylpolysiloxane with a viscosity of 4,000 centistokes (25 degrees Centigrade) as below $$HO\{(CH_3)_2SiO\}_{42}OH$$

in place of the organopolysiloxane comprising component (A) used in Example 1. The test which used gamma-(beta-aminoethyl)aminopropyltrimethoxysilane was designated as Comparison Example 5, and the test which used gamma-methacryloxypropyltrimethoxysilane was designated as Comparison Example 6. Testing was also conducted as Example 1, and these results are reported in Table 2.

As the results reported in Table 2 make clear, fabric treated with treatment agent according to the present invention had much lower laundry shrinkage percentages than in the comparison examples. Furthermore, creasing after laundering was lower for the treatment agent according to the present invention and the handle was also excellent. These results serve to demonstrate the suitability of the treatment agent according to the present invention as a treatment agent for 100% wool fabrics.

TABLE 2

| Test Items | | Invention Example | | Comparison Example | |
|---|---|---|---|---|---|
| | | 3 | 4 | 5 | 6 |
| Laundry shrinkage (%) | Warp | 3.3 | 3.6 | 10.8 | 11.1 |
| | Fill | 1.7 | 1.8 | 7.2 | 8.3 |
| | Overall | 5.0 | 5.4 | 18.0 | 19.4 |
| Crease resistance (%) | Warp | 85.1 | 83.8 | 79.3 | 77.5 |
| Handle* | | 1 | 1 | 1 | 1 |
| Bulk feel* | | 1 | 1 | 1 | 1 |
| Global* evaluation | | 1 | 1 | 2 | 2 |

*1 = excellent; 2 = unsuitable, due to large shrinkage.

EXAMPLE 3

179 Parts octamethylcyclotetrasiloxane and 1 part gamma-(beta-aminoethyl)aminopropylmethyldimethoxysilane $$H_2NCH_2CH_2NH(CH_2)_3Si(CH_3)(OCH_3)_2$$

were stirred to homogeneity, 12 parts dicocoalkyldimethylammonium chloride and 360 parts water were mixed to homogeneity, and this was then passed three times through an homogenizer at a pressure of 400 kg/cm$^2$. The product was transferred to a four-neck flask, 0.5 g potassium hydroxide was added, and polymerization was conducted by maintenance for 10 hours at 70 degrees Centigrade. To 240 parts of the emulsion thus obtained were added 1.5 parts gamma-glycidoxypropyltrimethoxysilane

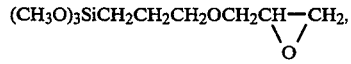

80 parts colloidal silica (Snowtex BK from Nissan Kagaku Kogyo Kabushiki Kaisha 80% water 20% colloidal silica) and 2 parts condensation-reaction catalyst as used in Example 1 followed by maintenance for 10 days at 50 degrees Centigrade. A treatment bath (Invention Composition Number 5) was prepared by the addition of 3,000 parts water to 100 parts of the emulsion thus obtained.

For comparison, octamethylcyclotetrasiloxane (100 parts), 12 parts dodecylbenzenesulfonic acid, and 360 parts water were first mixed to homogeneity and then uniformly emulsified with an homogenizer at a pressure of 400 kg/cm$^2$. The emulsion thus obtained was transferred to a four-neck flask, heated at 90 degrees Centigrade for 2 hours, cooled to 45 degrees Centigrade, subsequently held there for 8 hours, and cooled. The pH was then brought to 9.5 by the addition of 6 parts 28% aqueous ammonia. 240 Parts of the emulsion thus obtained was taken, and a treatment bath (Comparison Example 7) was prepared by the addition thereto of gamma-glycidoxypropyltrimethoxysilane, colloidal silica, and condensation-reaction catalyst followed by heating and dilution all under the same conditions as above.

65% polyester/35% cotton knit fabric (cut to 50×50 cm) was immersed in the treatment bath of Invention Number 5 or Comparison Example 7, withdrawn, wrung out to a 100% expression ratio using a mangle roll, spread out on a flat wire screen and dried for one 24-hour period, and then heat-treated for 3 minutes at 150 degrees Centigrade in a hot-air circulation oven. The flexural rigidity, crease resistance, elongation, and elongation recovery were then measured in the wale direction based on JIS L-1018 (Test Methods for Knit Fabrics), and the handle was evaluated by feel.

As the results in Table 3 make clear, the treatment agent according to the present invention also provided 65% polyester/35% cotton knit fabric with much better properties (elongation, elongation recovery, crease resistance, handle, etc.) than did the comparison examples. Invention Composition No. 5 yireled a very soft fabric with good rebound and good bulk feel. Comparison Composition No. 6 yielded a fabric with unsatisfactory rebound and bulk feel. Comparison Composition No. 6 yielded a fabric which was coarse and hard, and lacked softness.

TABLE 3

| Test Items | Present Invention 5 | Comparison Examples 7 | 8 |
|---|---|---|---|
| Flexural rigidity (mm) | 30 | 32 | 35 |
| Crease resistance (%) | 92 | 83 | 78 |
| Elongation (%) | 50 | 45 | 44 |
| Elongation recovery (%) | 91 | 80 | 76 |
| Global Evaluation | Excellent | Unsuitable | Unsuitable |

Effects of the Invention

The emulsion-type fiber treatment agent composition according to the present invention can equip fibers with a durable shrinkage resistance, softness, smoothness, etc., because it forms a strong, solid film by reaction among the base material, crosslinker, and colloidal silica as the water evaporates. These effects are reinforced by binding between the functional groups present in the fiber and such functional groups as the aminoalkyl groups bonded in the organopolysiloxane base material, the silanol groups bonded in the colloidal silica, and the amino, epoxy, methacryloxy, or acryloxy groups bonded in the crosslinker. Accordingly, the treatment agent according to the present invention is distinguished by a particular effectiveness relative to animal fibers such as wool which carry large numbers of functional groups and is therefore highly effective for the shrinkproofing of same.

That which is claimed is:

1. A fiber treatment agent composition which consists essentially of (A) 100 weight parts organopolysiloxane which has a viscosity of at least 10 centistokes at 25 degrees Centigrade and which has the following general formula $$AR_2SiO(R_2SiO)_m(\underset{\substack{|\\ R^1(NHCH_2CH_2)_aNR^2R^3}}{R}SiO)_nSiR_2A$$

wherein R is the same or different monovalent hydrocarbon group having 1 to 20 carbon atoms, $R^1$ is a divalent hydrocarbon group, $R^2$ and $R^3$ are groups selected from the hydrogen atom and monovalent hydrocarbon groups, the group A is the hydroxyl group or an alkoxy group, m and n are each integers with values of at least 1, and a is an integer with a value of zero to 5, (B) 0.1 to 30 weight parts organosilane with the following general formula $$\overset{\substack{R_b\\ |}}{Q}Si(OR^4)_{3-b}$$

wherein Q is a monovalent hydrocarbon group having 1 to 20 carbon atoms or a monovalent group which contains the epoxy group, amino group, acryloxy group, or methacryloxy group; R is a monovalent hydrocarbon group having 1 to 20 carbon atoms; $R^4$ is a monovalent hydrocarbon group having 1 to 5 carbon atoms; and b is an integer with a value of zero or 1; or partial hydrolysis condensate thereof, (C) 10 to 50 weight parts colloidal silica, (D) 0.1 to 20 weight parts condensation-reaction catalyst, (E) 1 to 30 weight parts surfactant selected from nonionic and cationic types, and (F) water.

2. A fiber treatment agent composition according to claim 1 in which the group Q in component (B) is an epoxy-containing monovalent group.

3. A fiber treatment agent composition according to claim 1 in which the group Q in component (B) is an amino-containing monovalent group.

4. A fiber treatment agent composition according to claim 1 in which the group Q in component (B) is a methacryloxy-containing monovalent group.

5. A fiber treatment agent composition according to claim 1 in which the group R in components (A) and (B) is a methyl group and the group $R^1(NHCH_2CH_2)_aNR^2R^3$ is $(CH_2)_3NHCH_2CH_2NH_2$.

6. A fiber treatment agent composition according to claim 5 in which component (B) is

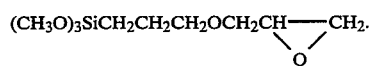

7. A fiber treatment agent composition according to claim 5 in which component (B) is $H_2NCH_2CH_2NH(CH_2)_3Si(OCH_3)_3$.

8. A fiber treatment agent composition according to claim 5 in which component (B) is a $CH_2{=}C(CH_3)COO(CH_2)_3Si(OCH_3)_3$.

9. A method for treating fibers, said method comprising applying the fiber treatment agent composition of claim 1 to said fibers and drying the thus-treated fibers.

10. A method according to claim 9 wherein the thus-treated fibers are heated for 3 to 10 minutes at 130 to 160 degrees Centigrade.

* * * * *